United States Patent [19]

Kibarer

[11] Patent Number: 4,949,487

[45] Date of Patent: Aug. 21, 1990

[54] ILLUMINATED DISPLAY

[76] Inventor: Fadil Kibarer, Pont de l'Isere, Tain L'Hermitage, Dröme, France

[21] Appl. No.: 266,726

[22] Filed: Nov. 3, 1988

[51] Int. Cl.[5] ..... G09F 13/28

[52] U.S. Cl. ..... 40/551; 40/552; 40/541; 362/404; 439/118

[58] Field of Search ..... 40/552, 545, 550, 551, 40/541; 362/808, 807, 806, 226, 404, 147; 439/110, 115, 117, 118, 119, 120

[56] References Cited

U.S. PATENT DOCUMENTS

| | | | |
|---|---|---|---|
| 1,075,767 | 10/1913 | Crane, Jr. | 40/552 |
| 2,713,629 | 7/1955 | Etzkorn | 40/545 |
| 2,895,245 | 7/1959 | Spangler | 40/552 |
| 3,109,598 | 11/1963 | Morgan | 362/226 |
| 4,190,309 | 2/1980 | Glass | 439/118 |
| 4,300,068 | 11/1981 | Baird et al. | 362/806 |
| 4,591,764 | 5/1986 | Nilssen | 362/404 |

FOREIGN PATENT DOCUMENTS

| | | | |
|---|---|---|---|
| 476844 | 9/1915 | France | 40/550 |
| 653712 | 3/1929 | France | 40/552 |
| 1139329 | 6/1957 | France | 439/118 |
| 2610750 | 8/1988 | France | 40/541 |
| 567478 | 10/1957 | Italy | 40/550 |

*Primary Examiner*—Kenneth J. Dorner
*Assistant Examiner*—J. R. Hakomaki
*Attorney, Agent, or Firm*—Herbert Dubno

[57] ABSTRACT

A modular illuminated display has individual symbol elements each with small electric ampules spaced apart therein and selectively mounted on a U-section rail so that terminals of the symbol elements can mechanically support them on the rail and effect electrical connection between conductors and the inner walls of the rail with the lamp ampules of the mounted symbol elements.

6 Claims, 2 Drawing Sheets

ILLUMINATED DISPLAY

FIELD OF THE INVENTION

My present invention relates to an illuminated display and, more particularly, to a highly versatile display capable of a great variety of applications, e.g. in stores to indicate shelving locations, for information, presentation, for promotion of products, for public space identification and information and for various signaling purposes.

BACKGROUND OF THE INVENTION

There are numerous systems utilizing light for signaling and information-portraying purposes.

For example, a panel having a painted or printed sign illuminated by lights disposed around or spaced from the panel, can be used for the display of information of various types, for signaling and for various public information purposes. In general, however, such systems have the drawback that the panel is single purpose and must be repainted or recovered for use to convey different information. Furthermore, the panel completely fills the space occupied thereby and obstructs the view behind the panel. Also the illuminating system must be developed as a unit separate from the panel.

There are displays which back-light a panel filling a field of view so that the informational message can be seen from a distance. While these displays incorporate the source of illumination in the panel itself, they nevertheless have the drawback that they are single purpose and not convenient to change and, of course, obstruct the field of view.

There is, of course, a full spectrum of displays between the panel-type displays described, moving-light displays which are of high versatility with respect to the message but are expensive and also can obstruct a field of view, and neon-sign and other open displays where alphanumeric characters are formed from neon tubes so that there is a minimum obstruction of the field behind the display.

Neon-tube displays, however, have the drawback that they are usually single purpose as well and require complex fabrication procedures. By and large, the cost of such displays is high and the esthetic results are poor.

OBJECTS OF THE INVENTION

It is, therefore, the principal object of the present invention to provide a highly esthetic and versatile display which is free from the drawbacks of the illuminated displays mentioned above and other single-purpose and panel displays, and which also can permit viewing of areas behind the display.

Another object of this invention is to provide an illuminated display which is of simple construction, esthetic character and a modular structure permitting variation of the display throuqh the use of standard elements.

Still another object of the invention is to provide a luminous display which is esthetically pleasing, of low cost and environmentally compatible in the sense that it does not materially obstruct the view of regions behind the display.

SUMMARY OF THE INVENTION

These objects and others which will become apparent hereinafter are attained, in accordance with the present invention in an illuminated display which comprises a bar provided with means for fixing or suspending the bar from a support and constituted by a U-section rail whose interior walls are provided all along their length with electrical conductors. Illuminated elements of the display, which can be alphanumeric characters or other standard characters, each are provided with a connecting terminal of a section corresponding to the internal section of the rail and adapted to be fixed at any location therealong, these terminals being provided with contacts for automatic electrical connection with the conductors of the bar as the terminals are fitted into the U-section rail.

Depending upon the desired application for the display according to the invention, the bar can be either fixed on a support such as a wall or can be suspended from a support such as a ceiling or frame.

The bar can be provided with any desired number of the standard illuminated elements which can be selected to compose a message or display indicia for any purpose.

Where the display is intended to provide a message utilizing the alphanumeric characters, according to the invention, the individual numerals and letters form standard elements which can be selected from an available font of these elements in an assortment and number necessary to compose the message and are fixed in appropriate succession on the bar.

As a consequence, the setup of a particular display is extremely rapid and the cost of any particular display is comparatively low since selection is made from standard illuminated elements which are available for any particular message displayed. By comparison with other displays which are visible from afar and are illuminated, the cost of the system is extremely low.

According to a feature of the invention, each illuminable element adapted to be fixed to the bar and to be fed with electric current comprises a tube of transparent or translucent material containing a multiplicity of small electric lamps, conveniently referred to as electric ampules because of their shapes, spaced along the tube and, with the tube, reproducing the shape of an alphanumeric character or some other symbol to be viewed. This arrangement has been found to have a considerable advantage over neon and fluorescent tubes because of its simplicity and low cost, but also has a significant advantage because of its esthetic appearance. The device does not have to be placed on or against a wall but can be suspended from a support so as to be visible from all sides and, of course, is of an open construction so that it does not interfere with a view of the region behind the display device.

In a best-mode embodiment of the invention, each illuminated symbol adapted to be fixed on the bar and to be fed with electric current individually from the bar, is formed from two half-shells of a synthetic resin material such as a transparent or translucent polycarbonate. The shells are provided along their assembly edges with mating pins and complementary holes. One of the two half-shells comprises in spaced relationship along the length thereof, blocks which extend transversely to the longitudinal edges of the half-shell and which are provided with parallel grooves which may also extend parallel to the longitudinal edges. The aligned grooves on each side serve to support and fix the electric supply conductors of the ampules. The two half-shells are assembled to one another by ultrasonic welding.

At an end of the tube formed by the half-shells, the connector previously described can be anchored and can have its contacts and electrically conducting relationship with the conductors running through the tube.

The illuminated symbol elements of the invention can be manufactured at low cost because the two half-shells can be fabricated by injection molding and the symbol elements contain a markedly reduced number of elements from earlier display systems, namely, the conductors, the lamp ampules and the connection terminal.

To promote diffusion of the light generated by the lamp ampules at least one end of the two half shells is striated.

According to another feature of the invention, the lamp ampoules of each signal element are electrically connected in parallel with one another and a low-voltage transformer can be mounted in the respective terminal or connected to the bar and the symbol elements themselves are connected in parallel to the bar. The low-voltage transformer can deliver, for example 12 volts and all of the lamp ampules can be energized by 12 volts each.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
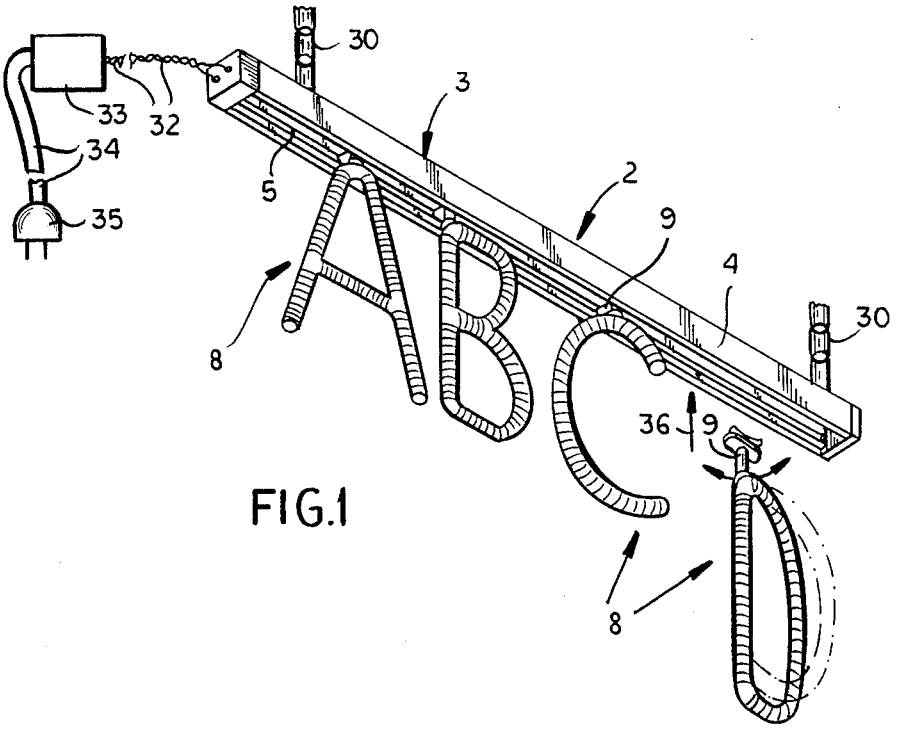
FIG. 1 is a perspective view of an illuminated display according to the invention, illustrating the mounting of one of the symbol elements thereof.

The illuminated display shown in the drawing comprises a rail 2 of U-section adapted to be mounted on a support such as a wall, or on a ceiling, or to be suspended from a support. The means provided for this purpose in the illustration of FIG. 1 is the chain 30 shown to support the rail from above.

The rail 2 comprises a web 3 from which two flanges 4 extend downwardly perpendicular to the web 3 and parallel to each other.

Each of the flanges 4 has an inwardly turned ledge 31 and spaced above these ledges, a respective electrically insulating channel 5, 6 opening inwardly and receiving a conductor 7.

The conductors 7 can be connected to a source of electric current by, for example, leads 32 at one end of the bar (FIG. 1) and including a low-voltage transformer 33 connected by a line cord 34 to a plug 35 adapted to be plugged into a socket delivering line current. The transformer 33 may have an output of 12 volts so that there is no risk of severe electric shock at those portions of display which may be located in a public place.

The display according to the invention comprises also a number of illuminated symbol elements generally designated at 8 and forming, for example, alphanumeric characters. These elements 8 are constituted by tubes and in FIG. 1 represent the first four letters of the alphabet A to D.

Each illuminated symbol element 8 is provided with a terminal 9 which is not removable from the element and which serves on the one hand to attach the element 8 to the rail and, on the other hand, to electrically connect this element to the conductors 7.

Figure 2:
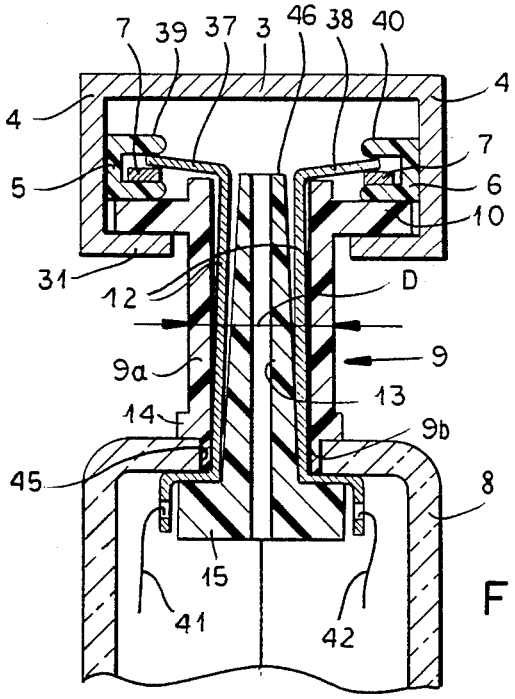
FIG. 2 is a cross-sectional view through the rail of one of the elements thereto drawn to a larger scale than FIG. 1.

As can be seen in particular from FIG. 2, the terminal 9 may have a shank 9*a* which is cylindrical and of a diameter D which is slightly less than the width of the opening left between the ledges 30 and 31. A pair of wings or projections 10 extend from this shank and are intended to overlie the ledges 31 and to lock beneath the channels 5 and 6 when the terminal 9 is inserted in the direction of arrow 36 into the U-section rail and the element 8 is rotated through a quarter of a turn about the axis of the shank 9*a*.

Connected to the rotatable part of the connector are a pair of conductor leaves 12 which have contact portions represented at 37 and 28 adapted to swing into the channels 5 and 6 and to engage between the conductors 7 and the upper flanges 39 and 40 of these channels as can be seen in FIG. 2 to provide electrical connection between the conductors 7 and the conductive leaves 12.

The latter are connected by flexible conductors 41 and 42 to the conductors running through the symbol element as will be described in greater detail below. The wings 10 thus provide mechanical support for the symbol element on the rail while the contacts 37 and 38 provide the electrical connection thereto.

The central part of the terminal 9 is provided with a bore 13 ensuring ventilation of the interior of the symbol element. The cylindrical shank 9*a* is extended by a square section portion 9*b* sealingly received in an opening 45 of square shape in the illuminated symbol element 8.

Attachment of the terminal is effected by a rib 14 bearing on the outer wall of the tubular element 8 and a rib or flange 15 of a central body 46 forced into the interior of the terminal. The parts may be thermally welded together and all of the electrically insulating elements of the terminal may be constituted by synthetic resin such as a polystyrene.

Figure 3:
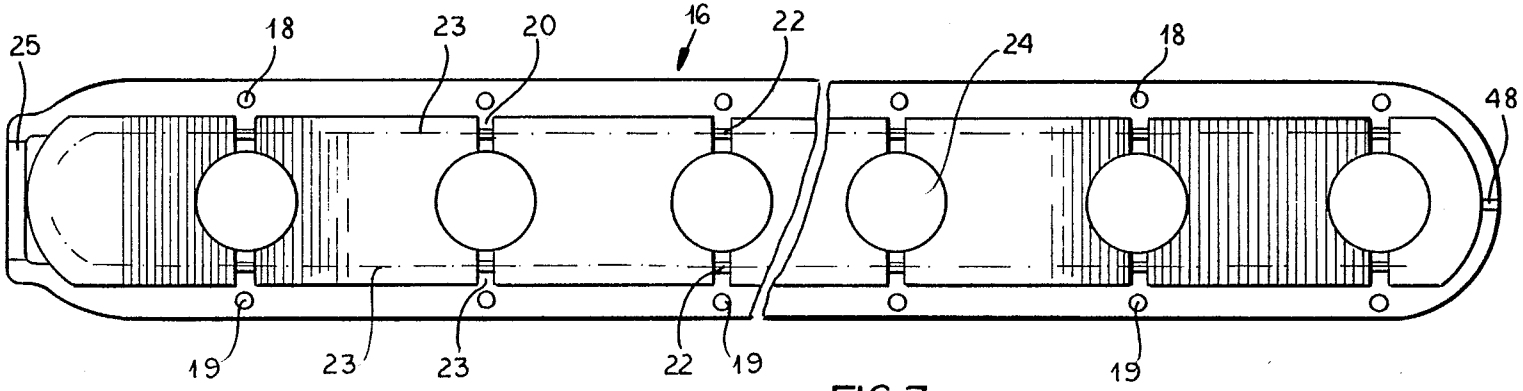
FIG. 3 is an elevational view of a half-shell constituting one of the illuminable symbol elements of the display.
Figure 4:
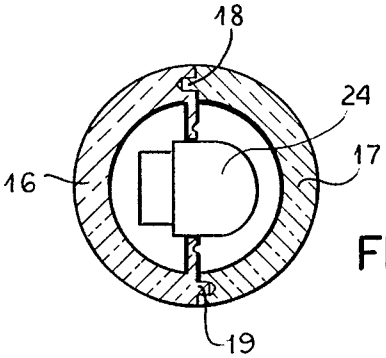
FIG. 4 is a transverse section through one of the elements.

As can be seen from FIGS. 3 and 4, each decorative symbol element is constituted by two half-shells 16 and 17 of a semicylindrical cross section and of which the half-shell 16 is shown in a plan view in FIG. 3.

The half-shell 16 adapted to form the letter I comprises along one of its longitudinal-assembly edges, spaced apart holes 18 adapted to receive pins of the other shell and, along its other longitudinal assembly edge, the pin 19 which are adapted to extend into the corresponding holes of the other shell.

The half-shell 16 is also provided in the region of its two longitudinal edges and regularly spaced therealong with blocks 20, each of which is formed with a longitudinal groove 22 serving to receive an electrical conductor 23 for feeding the lamp ampules 24 with electricity.

The conductors 23 are connected to the conductors 41 and 42, respectively, as previously described.

Each half-shell is formed at one of its ends with a recess 25 adapted to form part of the square opening 45 previously mentioned to receive an end of the connecting terminal 9.

The lamp ampules are connected to the two conductors 23 in a manner which has not been illustrated in the drawing. The lamp ampules are preferably 12 volt lamps.

After assembly of the two half-shells by engagement of the pins 19 in the holes 18, they may be ultrasonically welded together to form a continuous tube. A hole, e.g. formed by the groove 48, can be provided at the bottom end of each symbol element.

It will be apparent that the invention represents a significant improvement over prior techniques for providing luminous displays because of its simplicity and the fact that the symbol elements can be attached to the bar at any point along the length thereof.

I CLAIM:

1. An illuminated display comprising:

a U-section rail formed along internal walls thereof with respective electrical conductors;

a plurality of different standard illuminable symbol elements each comprising electrically energizable lamp means; and a respective connector terminal of each of said elements electrically connected to the respective lamp means, receivable in said rail and having a cross section corresponding to an interior section thereof for mechanically supporting selected ones of said elements on said rail and effecting electrical connection with said conductors whereby said conductors can energize the respective lamp means, each of said symbol elements comprising a tube of a light transmitting material and each of said lamp means comprises a multiplicity of small electric lamp ampules spaced along the tube, said tube reproducing the shape of a symbol to be displayed, each of said tubes being formed from a pair of half-shells of synthetic resin material, said half-shells being formed with mating pins and holes enabling assembly of said half-shells to form said tube, one of said half-shells being provided with blocks spaced therealong and provided with grooves for receiving electrical conductors connected to said lamp ampules, said half-shells being ultrasonically welded together, said half-shells being formed with recesses at one end of said tube adapted to form a square opening, each of said terminals having a cylindrical shank extended by a square part fitting in said opening, said shank being formed with a pair of wings adapted to engage in said rail and support the respective symbol element thereon.

2. The illuminated display defined in claim 1 wherein said half-shells are formed from a polycarbonate.

3. The illuminated display defined in claim 1 wherein at least one of said half-shells is striated for light diffusion therefrom.

4. The illuminated display defined in claim 1 wherein said ampules of each symbol element are electrically connected in parallel.

5. The illuminated display defined in claim 1, further comprising a low-voltage transformer electrically connected to said conductors.

6. The illuminated display defined in claim 5 wherein said transformer is a 12-volt transformer.

* * * * *